US006183810B1

(12) United States Patent
Ota

(10) Patent No.: US 6,183,810 B1
(45) Date of Patent: Feb. 6, 2001

(54) COATING FILM FORMING METHOD AND COATING APPARATUS

(75) Inventor: Yoshiharu Ota, Kumamoto-ken (JP)

(73) Assignee: Tokyo Electron Limited (JP)

( * ) Notice: Under 35 U.S.C. 154(b), the term of this patent shall be extended for 0 days.

(21) Appl. No.: 09/233,378

(22) Filed: Jan. 18, 1999

(30) Foreign Application Priority Data

Jan. 21, 1998 (JP) ..... 10-022547

(51) Int. Cl.[7] ..... B05D 3/12

(52) U.S. Cl. ..... 427/240; 427/425; 118/52; 118/320

(58) Field of Search ..... 427/240, 425; 118/52, 320

(56) References Cited

U.S. PATENT DOCUMENTS 5,374,312 * 12/1994 Hasebe et al. ..... 118/52
5,571,560 * 11/1996 Lin ..... 427/240
5,772,764 * 6/1998 Akimoto ..... 118/319
5,945,161 * 8/1999 Hashimoto et al. ..... 427/240
5,962,070 * 10/1999 Mitsuhashi et al. ..... 427/240
5,972,426 * 10/1999 Kutsuzawa et al. ..... 427/240

* cited by examiner

*Primary Examiner*—Shrive Beck
*Assistant Examiner*—Jennifer Calcagni
(74) *Attorney, Agent, or Firm*—Fulbright & Jaworski L.L.P.

(57) ABSTRACT

Disclosed is a method of forming a coating film, in which a coating solution is supplied from a linear nozzle onto a substrate held by a spin chuck arranged inside a cup having an opening so as to form a coating film on the substrate, comprising the steps of (a) allowing a spin chuck to hold rotatably a substrate, and (b) moving the linear nozzle and supplying a coating solution from the linear nozzle onto the substrate while rotating the substrate in a moving direction of the linear nozzle.

17 Claims, 6 Drawing Sheets

COATING FILM FORMING METHOD AND COATING APPARATUS

BACKGROUND OF THE INVENTION

The present invention relates to a coating film forming method and to a coating apparatus for forming a coating film such as a photoresist film or an anti-reflective coating film by applying a coating solution to a substrate such as a glass substrate for a liquid crystal display (LCD) device.

In the manufacturing process of an LCD device, a photolithography technology is employed as in the manufacturing process of a semiconductor device. In the photolithography employed for the manufacture of an LCD device, a resist coating film is formed on a glass substrate, followed by exposing the coating film to light in a predetermined pattern and subsequently developing the patterned coating film. Further, a semiconductor layer, an insulating layer and an electrode layer formed on the substrate are selectively etched to form a thin film of ITO (indium tin oxide), an electrode pattern, etc.

A so-called spin coating method is employed for coating an LCD substrate with a resist solution. A spin coater disclosed in, for example, U.S. Pat. No. 5,688,322 is employed for performing the spin coating treatment. In the spin coater disclosed in this prior art, an LCD substrate is held by vacuum suction by a spin chuck. Also, a solvent and a resist are supplied to the substrate, and an upper opening of a rotary is closed by a lid. Under this condition, the spin chuck and the rotary cup are rotated in synchronism. In this case, the coating amount of the resist, which is attached to the substrate, is only 10 to 20% of the supplied amount, with the remaining 80 to 90% of the supplied resist being discharged into a drain cup. The discharged resist solution is partly recycled for reuse. However, most of the discharged resolution is discarded.

In recent years, the LCD substrate is enlarged from 650×550 mm to 830×650 mm. If the LCD substrate is further enlarged in future, the consumption of the resist solution is further increased. Since the resist solution is wasted in a large amount in the conventional spin coating method as pointed out above, it is of high importance to decrease the waste of the resist solution.

BRIEF SUMMARY OF THE INVENTION

An object of the present invention to provide a coating film forming method and a coating apparatus which permit decreasing the consumption of a coating solution used for coating a substrate.

Since an LCD substrate is rectangular, it is generally difficult to coat uniformly the entire surface of the LCD substrate with a resist solution. For uniformly coating the LCD substrate with a resist solution, a parallel moving mechanism of a nozzle is operated to permit a linear nozzle to be moved in parallel with a stationary LCD substrate. During the movement, a resist solution is spurted from the linear nozzle onto the substrate. However, since the conventional parallel moving mechanism of a nozzle has a large foot print (occupied floor area), the apparatus provided with the particular mechanism is rendered bulky. As a result of an extensive research made in an attempt to overcome the above-noted difficulties, the present inventors have arrived at the present invention.

According to an aspect of the present invention, there is provided a method of forming a coating film, in which a coating solution is supplied from a linear nozzle onto a substrate held by a spin chuck arranged inside a cup having an opening so as to form a coating film on the substrate, comprising the steps of:

(a) allowing a spin chuck to hold rotatably a substrate; and (b) moving the linear nozzle and supplying a coating solution from the linear nozzle onto the substrate while rotating the substrate in a moving direction of the linear nozzle.

In the coating method of the present invention, the linear nozzle and the substrate are moved relative to each other to permit the linear nozzle to assume a predetermined posture relative to the substrate. As a result, the substrate is efficiently coated with the coating solution so as to decrease the consumption of the coating solution.

According to another aspect of the present invention, there is provided a coating apparatus, comprising a spin chuck for rotatably holding a substrate, a linear nozzle for supplying a coating solution onto the substrate, a nozzle moving mechanism for rocking the linear nozzle above the substrate, a rotary driving mechanism for rotating the spin chuck, a switching mechanism for allowing the coating solution to be spurted or not to be spurted from the linear nozzle, and a controller for controlling the rotary driving mechanism, the nozzle moving mechanism and the switching mechanism so as to supply the coating solution onto the substrate while rotating the substrate and moving the linear nozzle in a rotating direction of the substrate.

It is desirable for the linear nozzle to have a solution spurting port having a length corresponding to at least the shorter side of the rectangular substrate. Further, the coating apparatus may include a solvent supply source for supplying a solvent into the linear nozzle.

The coating apparatus may further include a shaking mechanism for shaking the linear nozzle to permit the longitudinal direction of the linear nozzle to be made parallel to the shorter side or longer side of the rectangular substrate, and a supporting arm mounted to the nozzle moving mechanism for supporting the linear nozzle. In this case, the shaking mechanism should desirably include a first bevel gear, a stationary frame for swingably supporting the supporting arm, a second bevel gear, a pivot joined to the linear nozzle, and a gear shaft arranged in a hollow portion of the supporting arm and provided with bevel gears engaged with the first and second bevel gears, respectively. Also, it is possible for the shaking mechanism to include a pivot rotatably mounted to the supporting arm and joined to the linear nozzle, and a small motor whose rotary driving shaft is joined directly or indirectly to the pivot and whose operation is controlled by the controller.

The coating apparatus may further include a back-and-forth moving mechanism for moving the linear nozzle forward or backward in the longitudinal direction of the linear nozzle until the solution spurting port of the linear nozzle overlaps with the entire region in the width direction of the rectangular substrate.

Further, the controller controls the operations of the nozzle moving mechanism and the rotary driving mechanism to permit a rocking angle $\alpha$ of the linear nozzle to be made equal to a rotating angle $\gamma$ of the substrate and to permit a differentiation amount ($\alpha'=d\alpha/dt$), which is obtained by differentiating the rocking angle a with time, to be made equal to a differentiation amount ($\gamma'=d\gamma/dt$), which is obtained by differentiating the rotating angle $\gamma$ with time.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
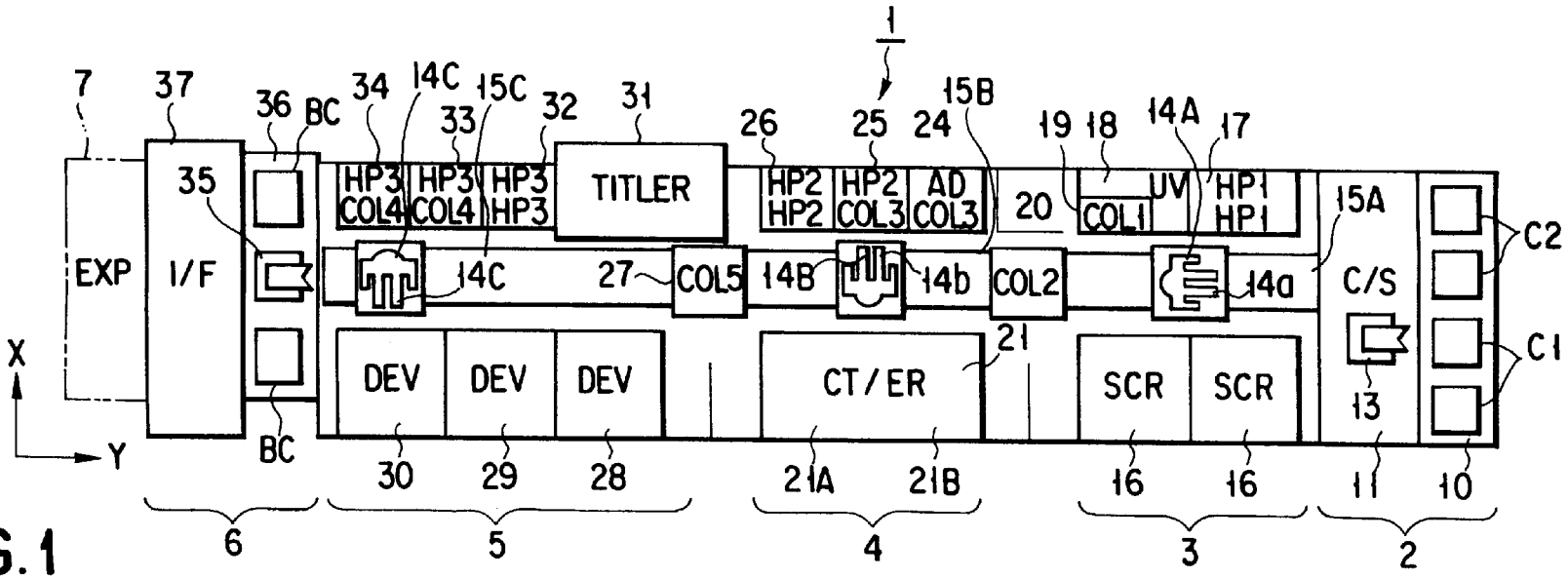
FIG. 1 is a plan view showing a resist coating-developing system for an LCD substrate.
Figure 2:
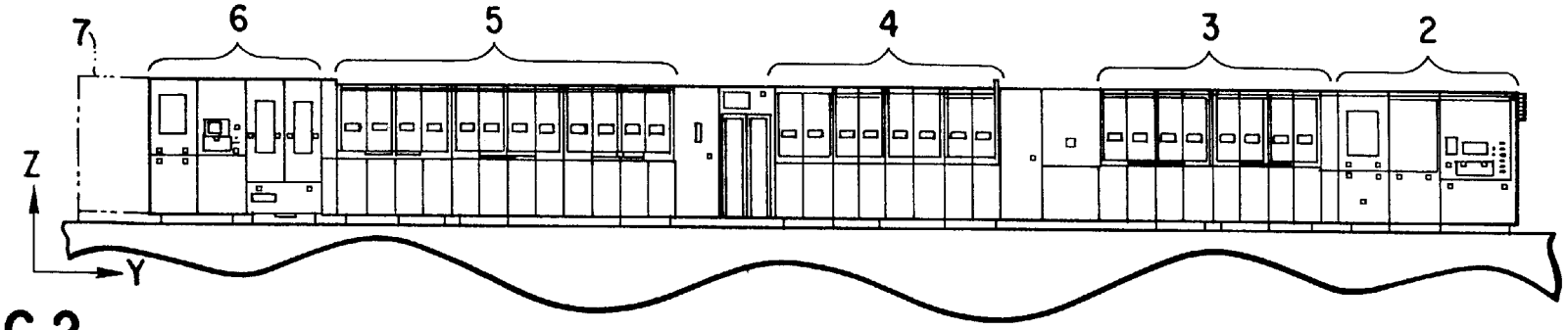
FIG. 2 is a front view showing a resist coating-developing system for an LCD substrate.

Let us described preferred embodiments of the present invention with reference to the accompanying drawings. Specifically, a coating-developing system 1 comprises a loader/unloader section 2, a first process section 3, a second process section 4, a third process section 5 and an interface section 6, as shown in FIGS. 1 and 2. The system 1 is provided with various processing mechanisms for coating an LCD substrate G with a photoresist solution and developing the coated resist film and is connected to an light exposure apparatus 7 positioned adjacent to the interface section 6.

The loader/unloader section 2 comprises a cassette table 10 and a transfer section 11 each extending in an X-axis direction. At most four cassettes C1, C2 can be arranged in the cassette table 10. LCD substrates G before processing are housed in the two cassettes C1, with the LCD cassettes G after the processing being housed in the other two cassettes C2. Each cassette is capable of housing a maximum of, for example, 25 LCD substrates. Incidentally, the LCD substrate G is sized at 830 mm×650 mm.

A first sub-arm mechanism 13 is mounted to the transfer section 11 of the loader/unloader section 2. The first sub-arm mechanism 13 is provided with a holder for loading/unloading the substrate G into/out of each of the cassettes C1, C2, a back-and-forth driving mechanism for moving the holder back and forth, an X-axis driving mechanism for moving the holder in the X-axis direction, a Z-axis driving mechanism for moving the holder in a Z-axis direction, and a θ-swinging mechanism for rocking and swinging the holder about the Z-axis.

The first process section 3 comprises a central transfer path 15A extending in a Y-axis direction, a first main arm mechanism 14A movable along the transfer path 15A, and a plurality of process units 16, 17, 17 and 18. Two wet type washing units 16 are arranged on one side of the transfer path 15A. Each of these washing unit 16 is provided with a brush scrubber SCR for scrub-washing the surface of the substrate G with a rotary brush while applying a washing solution onto the substrate G. On the other hand, a heating unit 17, a dry type washing unit 18 and a cooling unit 19 are arranged on the other side of the transfer path 15A. The heating unit 17 comprises and upper stage hot plates HP1 and a lower stage hot plate HP1 for heating the substrate G. The dry type washing unit 18 comprises an ultraviolet light washing device UV for washing the surface of the substrate G by irradiating the substrate G with an ultraviolet light. The cooling unit 19 comprises a cooling plate COLL for cooling the substrate G. Further, the first main arm mechanism 14A is provided with a holder 14*a* for holding the substrate, a back-and-forth moving mechanism for moving the holder 14*a* back and forth, a Y-axis driving mechanism for moving the holder 14*a* in the Y-axis direction, a Z-axis driving mechanism for moving the holder 14*a* in the Z-axis direction, and a θ-driving mechanism for rocking and swinging the holder 14*a* about the Z-axis.

The second process section 4 comprises a central transfer path 15B extending in the Y-axis direction, a second main arm mechanism 14B movable along the transfer path 15B, and a plurality of process units 21, 24, 25 and 26. The process unit 21, which is provided with a resist coating device 21A and a peripheral resist removing device 21B, is arranged on one side of the transfer path 15B. The substrate G, which is kept rotated about its own axis, is coated with a resist solution by the resist coating device 21A. On the other hand, an excess resist coating film is removed from the peripheral portion of the substrate G by the peripheral resist removing device 21B.

An adhesion/cooling unit 24, a heating/cooling unit 25 and a heating/heating unit 26 are arranged on the other side of the transfer path 15B. The adhesion/cooling unit 24 includes an adhesion device AD for applying a hydrophobic treatment to the surface of the substrate G with a vapor of HMDS and a cooling plate COL3 for cooling the substrate G. The heating/cooling unit 25 includes a hot plate HP2 for heating the substrate and a cooling plate COL3 for cooling the substrate. Further, the heating/heating unit 26 includes an upper stage hot plate HP2 and a lower stage hot plate HP2 for heating the substrate.

The third process section 6 comprises a central transfer path 15C extending in the Y-axis direction, a third main arm mechanism 14C movable along the transfer path 15C, and a plurality of process units 28, 29, 30, 31, 32, 33 and 34. Three developing units 28, 29, 30 are arranged on one side of the transfer path 15C. Each of these developing units 28, 29, 30 is provided with a developing device DEV for applying a developing solution to the substrate so as to develop the resist coating film. On the other hand, a titler 31, a heating/heating unit 32 and heating/cooling units 33, 34 are arranged on the other side of the transfer path 15C. Each of the second and third main arm mechanisms 14B, 14C is substantially equal to the first main arm mechanism 14A. It should be noted that a cooling unit 20 is arranged between the first process section 3 and the second process section 4. Likewise, a cooling unit 27 is arranged between the second process section 4 and the third process section 5. These cooling units 20 and 27 are used for temporarily storing the substrate G waiting for a processing.

The interface section 6 is interposed between the third process section and the light-exposure device 7. A second sub-arm mechanism 35 and two buffer cassettes BC are arranged in a transfer/waiting section 36. The second sub-arm mechanism 35 is substantially equal to the first sub-arm mechanism 13. Substrates G waiting for a processing are temporarily stored in each of these buffer cassettes BC. A delivery table (not shown) is mounted in a delivery section 37. The substrate G is delivered between the transfer mechanism (not shown) of the light-exposure device 7 and the second sub-arm mechanism 35 via the delivery table noted above.

Two loading/unloading ports (not shown) are formed in the front wall of the unit 21. The unprocessed substrate G is loaded into the resist coating section 21A through one of these loading/unloading ports. Also, the processed substrate G is unloaded from the peripheral coating film removing section 21B through the other port. Incidentally, a transfer mechanism (not shown) is arranged between the resist coating device 21A and the peripheral resist removing section 21B so as to permits the substrate G from being transferred from the resist coating device 21A into the peripheral resist removing section 21B.

Figure 3:
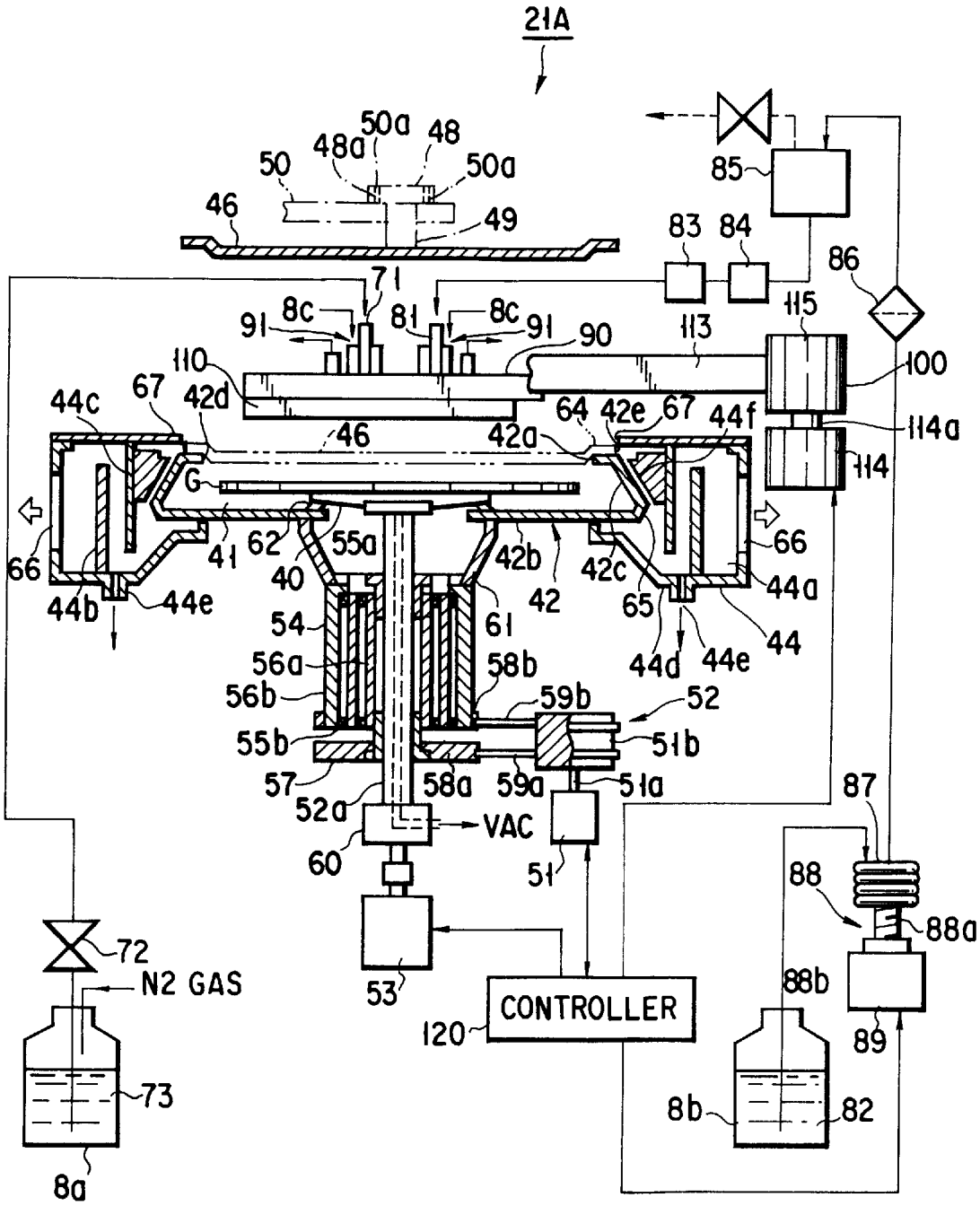
FIG. 3 is a cross sectional view, including a block diagram, showing a resist coating apparatus.

As shown in FIG. 3, the resist coating device 21A is provided with a spin chuck 40, a rotary cup 42, a drain cup 44, a lid 46, a robot arm 50, a solvent supply source 73, a resist solution supply source 82, a bellows pump 88, a nozzle moving mechanism 100, a nozzle section 110 and a controller 120. The rotary cup 42 is arranged to surround the spin chuck 40. Further, the drain cup 44 is arranged to surround the rotary cup 42. The lid 46 is detachably mounted to the upper opening of the rotary cup 42. A plurality of drain pipes 44*e* are connected to a bottom portion 44*d* of the drain cup 44. The waste liquid is discharged through these drain pipes 44*e* into a recovery-regeneration device (not shown).

The rotary cup 42 is mounted to surround the upper portion and the circumferential outer portion of the spin chuck 40. The rotary cup 42 is a cylindrical container having a bottom. A process space 41 for processing the substrate G is formed within the rotary cup 42. Also, an opening is formed in a central portion at the bottom 42*b* of the rotary cup 42. During the coating operation, the opening is closed by the spin chuck 40. A plurality of discharge holes 65 are formed through the side wall 42*c* of the rotary cup. Liquid droplets and mist are discharged through these discharge holes 65 from within the rotary cup 42 into the drain cup 44.

The spin chuck 40 is formed of a synthetic resin such as polyether ether ketone (PEEK). The rotating speed of a servo motor 51 is controlled by the controller 120. A rotary shaft 52*a* of a rotary driving mechanism 52 is joined to the lower portion of the spin chuck 40. The rotary shaft 52*a* is joined to a vertically movable cylinder 53 via a vacuum seal portion 60 and is also slidably joined to and supported by the lower portion of the rotary cup 42 via spline bearing 57.

The rotary shaft 52*a* is joined to the spline bearing 57 so as to be slidable in a vertical direction. The spline bearing 57 is mounted to the inner surface of a rotary inner cylinder 56*a* which is rotatably mounted to the inner surface of a stationary color 54 with a bearing 55*a* interposed therebetween. A driven pulley 58*a* is mounted to the spline bearing 57. Also, a belt is stretched between the driven pulley 58*a* and a driving pulley 51*b*. Further, a cylindrical body (not shown) is arranged on the side of the lower portion of the rotary shaft 52*a*. Within the cylindrical body, the rotary shaft 52*a* is joined to a cylinder 53 via the vacuum sealing portion 60. The rotary shaft 52*a* is moved in a vertical direction by the cylinder 53 so as to cause the spin chuck 40 to be moved in a vertical direction.

A rotatable outer cylinder 56*b* is mounted to the outer circumferential surface of the stationary color 54 with a bearing 55*b* interposed therebetween. Also, a connecting cylinder 61 is fixed to the upper end of the rotatable outer cylinder 56*b*. The rotary cup 42 is mounted to the rotary driving mechanism 52 via the connecting cylinder 61. A seal bearing 62 is interposed between the rotary cup 42 and the spin chuck 40 so as to permit the rotary cup 42 to be rotated relative to the spin chuck 40. A driven pulley 58*b* is mounted to the rotatable outer cylinder 56*b*, and a belt 59*b* is stretched between the driven pulley 58*b* and a driving pulley 51*b*. Incidentally, the diameter of the driven pulley 58*b* is equal to the diameter of the driven pulley 58*a*. Also, two belts 59*a* and 59*b* are wound about the common servo motor 51. It follows that the rotary cup 42 and the spin chuck 40 are rotated in synchronism.

The nozzle section 110 comprises a header 90, first and second nozzles 111, 112, and a nozzle moving mechanism 100. These first and second nozzles 111 and 112 are supported by a common supporting arm 113 and are moved by the nozzle moving mechanism between a home position outside of the drain cup 44 and an operating position inside the drain cup 44.

Figure 7:
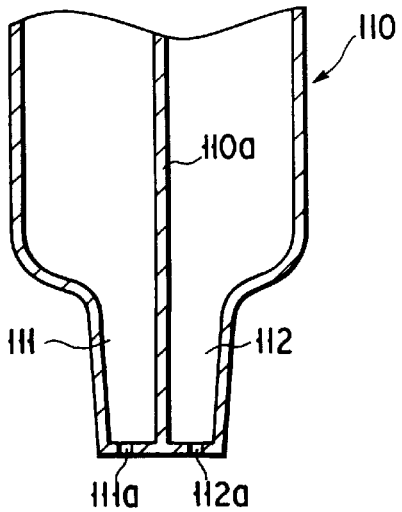
FIG. 7 is a cross sectional view schematically showing the tip portion of the nozzle portion.

As shown in FIG. 7, the inner space of the nozzle section 110 is partitioned by a partition plate 110 so as to form a fluid passageway of the first nozzle 111 a fluid passageway of the second nozzle 112. These two fluid passageways communicate with a discharge port 111*a* and another discharge port 112*a*, respectively. A solvent 8*a* is spurted from the discharge port 111*a*, with a resist solution 8*b* being spurted from the other discharge port 112*a*. Each of these discharge ports 111*a* and 112*a* consists of a large number of fine holes arranged in series. It is necessary for each of these discharge ports 111*a* and 112*a* to be not shorter than the short side of the substrate G. It is possible for the length of each of these discharge ports 111*a*, 112*a* to be substantially equal to the long side of the substrate G. In this case, however, the nozzle section 110 is rendered unduly heavy, leading to a low operability of the nozzle section 110. In order to decrease the weight of the nozzle section 110, it is desirable for the length of the discharge ports 111*a*, 112*a* to be equal to the length of the short side of the substrate G. Incidentally, each of these discharge ports 111*a*, 112*a* may be shaped slit-like.

As shown in FIG. 3, the first nozzle 111 communicates with the solvent tank 73 via a tube 71 and a valve 72. Also, a nitrogen gas supply source (not shown) communicates with the solvent tank 73. If a nitrogen gas is supplied into the solvent tank 73, the pressurizing force of the nitrogen gas causes the solvent 8*a* within the tank 73 to be supplied onto the substrate G. Incidentally, the operation of the nitrogen gas supply source is controlled by the controller 120.

The second nozzle 112 communicates with a tank 82 housing a resist solution 8*b* via a tube 81. Mounted to the tube 81 are a suck back valve 83, an air operation valve 84, a bubble removing mechanism 85, a filter 86 and a bellows pump 88 in the order mentioned. The bellows pump 88 includes a flexible portion 87. The flexible portion 87 is elongated or shrunk by a stepping motor 89 so as to allow a predetermined amount of the resist solution 8*b* to be supplied into the second nozzle 112.

The suck back valve 83 serves to bring the resist solution 8*b* remaining within the discharged fluid passageway of the nozzle 112 back into the header 90 so as to prevent the residual resist solution 8*b* from being solidified within the discharged fluid passageway.

A temperature control mechanism 91 is mounted to the header 90. A heat exchange fluid 8*c* is circulated into the inner fluid passageway of the temperature control mechanism 91. The heat exchange fluid 8*c* exchanges heat with the solvent 8*a* and, then, with the resist solution 8*b* so as to set the temperatures of the solvent 8*a* and the resist solution 8*b* at desired levels, e.g., 23° C.

An annular passageway 44*a*, which is formed inside the drain cup 44, communicates with four exhaust ports 66 formed through the outer circumferential wall of the drain cup 44. Each of these exhaust ports communicates with an exhaust device (not shown). Also, a radial exhaust passageway 67 is formed in an upper portion along the inner circumferential surface of the drain cup 44. The radial exhaust passageway 67 communicates with the annular passageway 44*a* and with the exhaust port 66.

Further, a plurality of drain holes 44*e* are formed at the bottom portion 44*d* interposed between the outer wall 44*b* and the inner wall 44*c*. A tapered surface 44*f* is formed in the inner circumferential wall of the drain cup 44. A small clearance is formed between the tapered surface 44*f* and the tapered surface 42*e* of the rotary cup 42. Incidentally, the rotary cup 42 is positioned inside the drain cup 44 in the mechanism shown in the drawings. However, it is also possible for the rotary cup 42 to be arranged above the drain cup 44.

Each part of the coating device 21A used for processing an LCD substrate G sized at 830×650 mm is sized as follows. Specifically, the drain cup 44 has an outer diameter of about 130 mm and a height (depth) of about 220 mm. Each of the lid 46 and the rotary cup (inner cup) 42 has an outer diameter of about 110 mm. Further, the rotary cup 42 has a height (depth) of about 40 mm.

A supporting member 49 which projects upward is mounted to the central portion on the upper surface of the lid 46. Also, a head portion 48 having a diameter larger than that of the supporting member is to the upper end of the supporting member 49. The robot arm 50 is inserted into the lower side of the head portion 48 of the lid 46 so as to allow an engaging pin 50*a* projecting from the robot arm 50 to be engaged with an engaging groove 48*a* of the head portion 48. If the head portion 48 is moved upward by this engagement, the lid 46 is moved upward from the cup 42.

Figure 4:
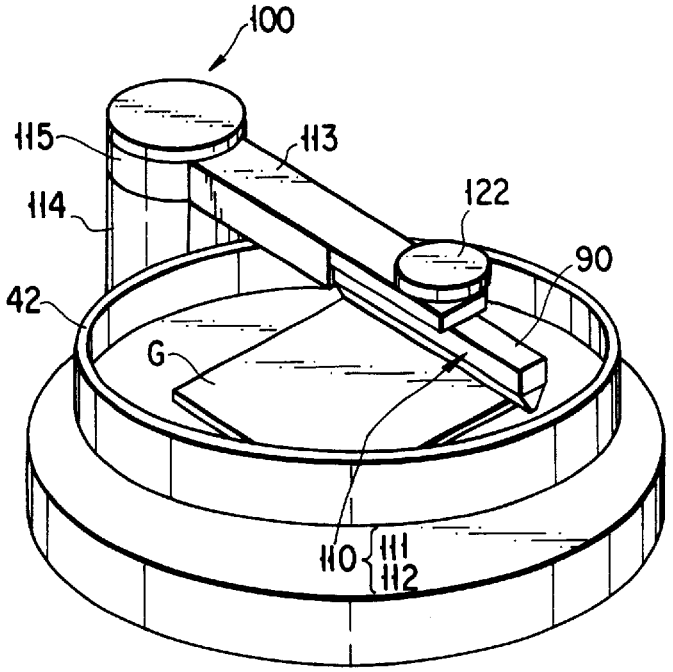
FIG. 4 is an oblique view schematically showing a coating apparatus according to one embodiment of the present invention.

As shown in FIG. 4, a spurting head 90 is mounted to the tip portion of a supporting arm 113, and the nozzle section 110 is mounted to the lower side of the spurting head 90. The proximal end portion of the supporting arm 113 is joined to a driving force transmitting section 115 of the nozzle moving mechanism 100, and the driving force transmitting section 115 is connected to a driving shaft 114*a* of a stepping motor 114. The power source circuit of the motor 114 is connected to the output side of the controller 120 such that the operation of the motor 114 is controlled by using the program stored in the memory of the controller 120.

Figure 5:
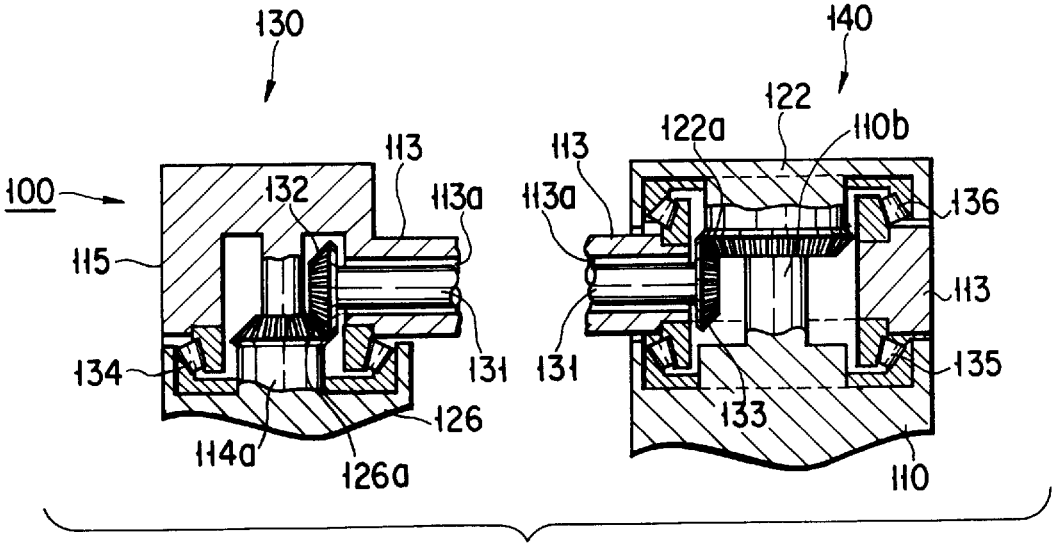
FIG. 5 is a cross sectional view showing a gist portion of a nozzle driving mechanism.
Figure 6:
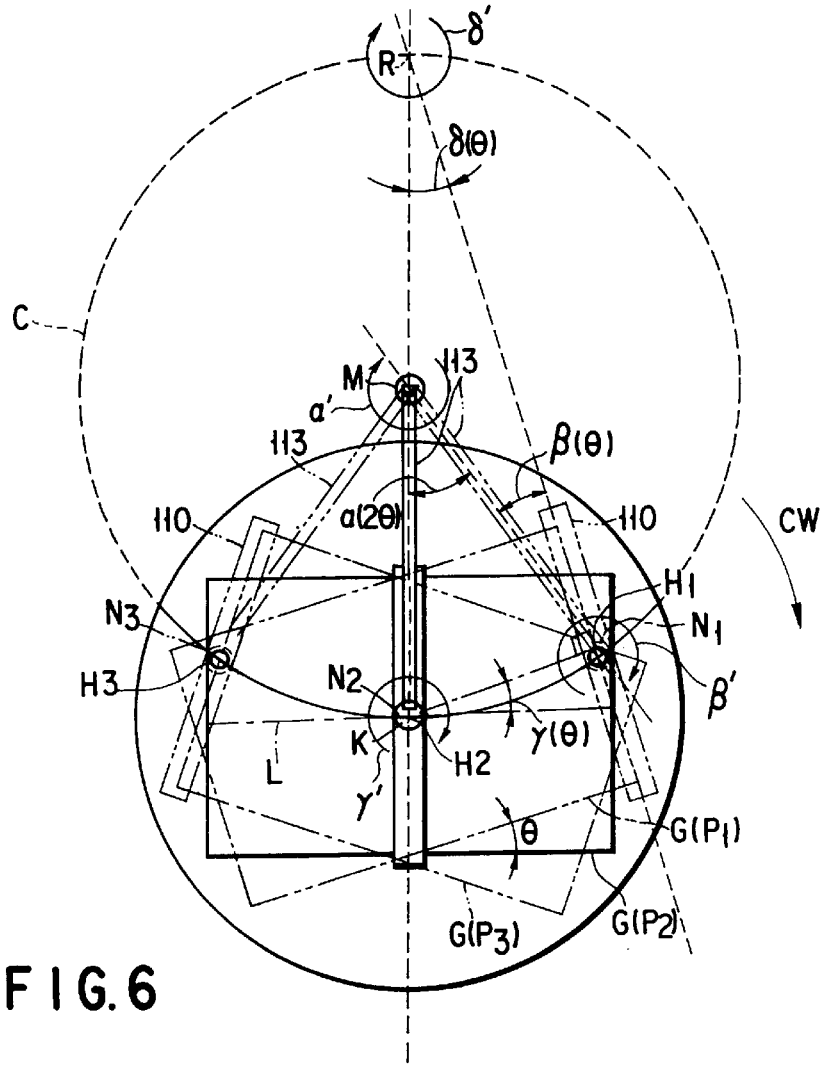
FIG. 6 is a plan view showing the positional relationship between a nozzle portion and the LCD substrate in the coating apparatus according to the embodiment of the present invention.

Let us describe the nozzle moving mechanism 100 with reference to FIGS. 5 and 6. Specifically, the nozzle moving mechanism 100 comprises a mechanism 130 for rocking the nozzle 110 about a vertical driving shaft 114*a* and a mechanism 140 for swinging the nozzle 110 about a pivot 122. The rocking mechanism 130 comprises a stepping motor 114 which is controlled by the controller 120. The driving shaft 114*a* of the motor 114 is joined to a case 115. The case 115 is joined to one end portion of the supporting arm 113 and is movably joined to a stationary frame 126 via conical roller bearing 134. On the other hand, the other end portion of the supporting arm 113 is joined to the nozzle section 110 via the conical roller bearing 135 SO as to support the nozzle section 110.

The supporting arm 113 is hollow. A gear shaft 131 is housed in a hollow portion 113*a* of the supporting arm 113. Bevel gears 132, 133 are mounted to the end portions of the gear shaft 131. One bevel gear 132 is engaged with a bevel gear 126*a* of the stationary frame 126, and the other bevel gear 133 is engaged with a bevel gear 122*a* of the pivot 122. Also, the pivot 122 is movably joined to the supporting arm 113 via a conical roller bearing 136. Further, the pivot 122 is joined to a connecting bar 110*a* of the nozzle section 110.

The gear ratio of the bevel gears 122*a*, 126*a*, 132 and 133 is determined to permit the rocking angle $\alpha(=2\theta)$ of the supporting arm 113 to be double the swinging angle $\delta(=\theta)$ and the shaking angle $\beta(=\theta)$ of the nozzle section 110, as shown in FIG. 6. It should be noted that the rocking angle $\alpha$ denotes the rotating angle of the arm 113 about a central point M, the swinging angle $\delta$ denotes the rotating angle of the nozzle section 110 about a central point R, and the shaking angle $\beta$ denotes the rotating angle of the nozzle section 110 about a central point N of the pivot 122. Further, the controller 120 controls the driving of the servo motor 51 and the stepping motor 114 to permit the rotation angle $\gamma(=\theta)$ of the spin chuck 40 to be equal to each of the rocking angle $\delta(=\theta)$ and the swinging angle $\beta(=\theta)$ of the nozzle section 110. To be more specific, the controller 120 permits the rocking of the arm 113, the swinging of the nozzle section 100 and the rotation of the substrate G to be performed in synchronism such that the nozzle section 110 and the substrate G are moved relative to each other so as to keep the positional relationship that the longitudinal axis of the nozzle section 110 is kept perpendicular to the longer side of the substrate G.

Under an optional position of the nozzle section 110, an angle ∠KHR is kept at 90°, with the result that the locus of the central point N of the nozzle section 110 depicts a circle C in which a line KR constitutes the diameter. By rocking the supporting arm 113 about the center M of the line KR, the central point N of the nozzle section 110 is kept moved along a central line L in the longitudinal direction of the substrate G. Since the central point N of the nozzle section 110 is kept positioned on the central line L in the longitudinal direction of the substrate G while allowing the nozzle section 110 to be kept perpendicular to the longer side of the substrate G, the substrate G and the nozzle section 110 can be scanned linearly relative to each other.

Figure 10:
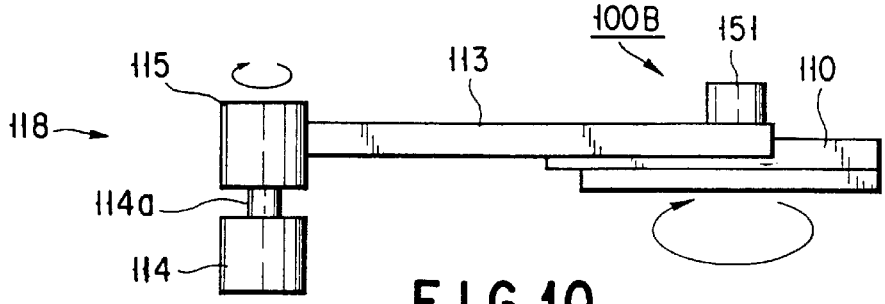
FIG. 10 schematically shows a shaking mechanism for shaking the linear nozzle in the apparatus according to another embodiment of the present invention.

Incidentally, a nozzle moving mechanism 100B equipped with a small stepping motor 151 as shown in FIG. 10 can be used in place of the nozzle moving mechanism 100. The driving shaft (not shown) of the motor 151 is joined to a pivot (not shown) in a central portion in the longitudinal direction of the nozzle section 110 via a decelerator (not shown). Also, the power source circuit of the motor 151 is connected to an output section of the controller 120. If the operations of these two motors 114 and 151 are controlled in synchronism by the controller 120, the supporting arm 113 is rocked and the nozzle section 110 is shaken so as to achieve the relative positional relationship between the nozzle section 110 and the substrate G shown in FIG. 6.

It is possible to arrange a plurality of spin chucks 40 on the circle C shown in FIG. 6 so as to coat a plurality of substrates G with a resist solution by commonly using the nozzle section 110.

Figure 8:
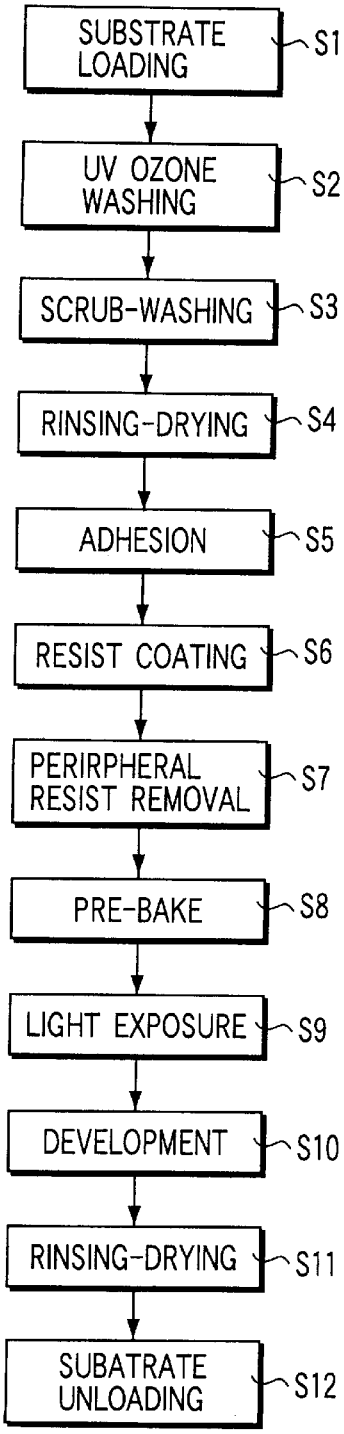
FIG. 8 is a flow chart showing a series of resist processing steps applied to an LCD substrate.

Let us describe a series of resist treating process of the LCD substrate G with reference to FIG. 8.

In the first step, a single substrate G is taken out of the cassette C1 by the sub-transfer arm 13 so as to be delivered onto the first main transfer arm 14A of the process section 3 (step S1). The substrate G is then transferred by the first main transfer arm 14A into the unit 18 for washing the substrate G with an ultraviolet light ozone (step S2). Further, the substrate G is transferred by the main transfer arm 14A into the unit 16 for subjecting the substrate G to a scrub-washing (step S3), followed by rinsing the substrate G with pure water and subsequently drying the substrate G under heat (step S4).

In the next step, the substrate G is transferred by the first main transfer arm 14A into the unit 24. Within the unit 24, an HMDS vapor is applied to the substrate G while heating the substrate G so as to apply an adhesion treatment to the surface of the substrate G (step S5). Further, the substrate G is delivered from the first main transfer arm 14A onto the second main transfer arm 14B. Then, the substrate G is transferred by the second main transfer arm 14B into the cooling unit 25 for cooling the substrate G.

The substrate G is taken out of the cooling unit 20 by the second main transfer arm 14B so as to be transferred into the unit 21. When the second main transfer arm 14B arrives at a position in front of the resist coating device 21A of the unit 21, the shutter (not shown) is opened and the substrate G is transferred into the resist coating device 21A. Then, the resist solution 8*b* is applied to the substrate G (step S6).

Figure 9:
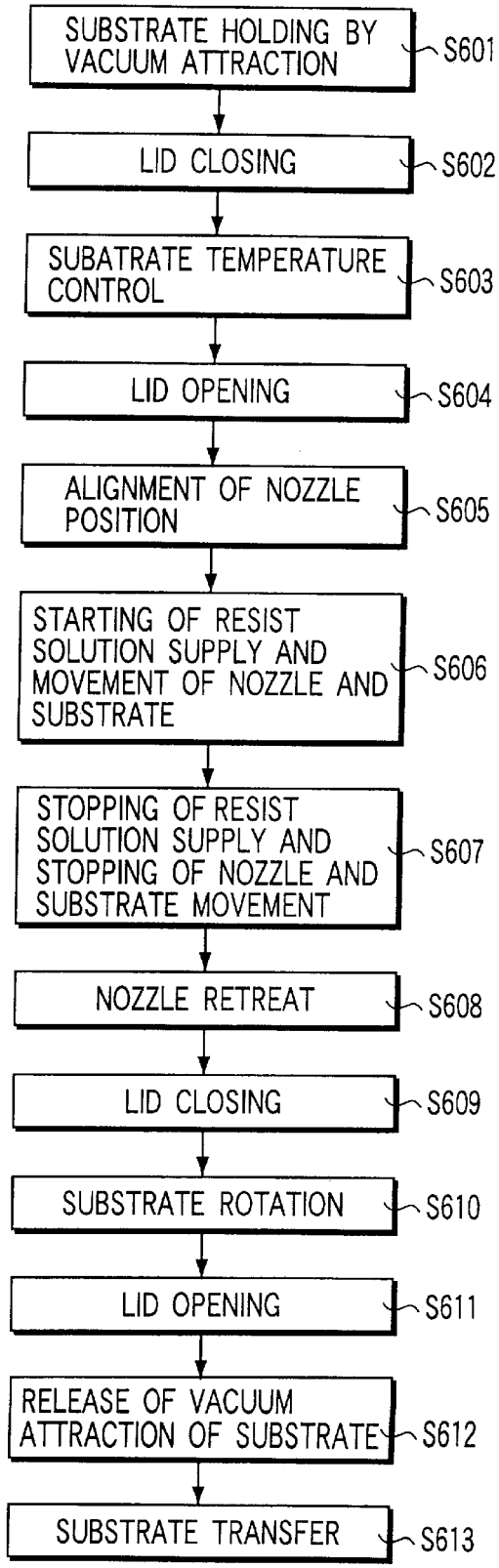
FIG. 9 is a flow chart showing a coating film forming method according to the embodiment of the present invention.

Let us describe the resist coating step S6 in detail with reference to FIG. 9.

In the first step, the lid 46 is opened, and the spin chuck 40 is moved upward so as to transfer the substrate G from the arm holder 14*b* of the second main arm mechanism onto the spin chuck 40. Then, the arm holder 14*b* is retreated from the unit 21, followed by closing the shutter. Under this condition, the spin chuck 40 holding the substrate G by vacuum suction is moved downward (step S601).

In the next step, the nozzle section 110 is moved from the home position toward the operating position so as to permit the nozzle 110 to be positioned right above the center of the substrate G. Under this condition, the solvent 8*a* is supplied from the first nozzle 111 onto the substrate G while rotating the substrate at a low speed. Then, the nozzle section 110 is brought back to the home position, followed by closing the lid 46 (step S602). Further, the temperature of the substrate G is controlled at a target temperature (23° C.) (step S603).

Then, the lid 46 is opened (step S604) and the nozzle section 110 is moved from the home position to the operating position. At the same time, the substrate G is rotated to align the positions of the nozzle section 110 and the substrate G such that the second nozzle 112 is overlapped with the shorter side of the substrate G as denoted by a two-dots-dash line in FIG. 6 (step S605).

Then, the resist solution 8*b* begins to be spurted from the second nozzle 112 and, at the same time, the nozzle section 110 and the substrate G are moved (step S606). In this step S606, the controller 120 permits the rocking of the arm 113, the swinging of the nozzle section 110 and the rotation of the substrate G to be performed in synchronism moves the nozzle section 110 and the substrate G such that the longitudinal axis of the nozzle section 110 is kept perpendicular to the longer side of the substrate G. As shown in FIG. 6, the rocking angle $\alpha(\angle N_1MN_2=2\theta)$ of the supporting arm 113 is twice the swinging angle $\beta(\angle MN_1R=\theta)$ of the nozzle section 110, and the rotation angle $\gamma(\angle H_1KH_2=\theta)$ of the spin chuck 40 is equal to the swinging angle $\beta(\angle MN_1R=\theta)$ of the nozzle section 110. To be more specific, when the substrate G is in a first position P1, the center N1 of the nozzle section 110 overlaps with the center H1 of the shorter side of the substrate G. When the substrate G is in a second position P2, the center N2 of the nozzle section 110 overlaps with the center K of rotation of the substrate G. Further, when the substrate G is in a third position P3, the center N3 of the nozzle section 110 overlaps with the center H3 of the shorter side of the substrate G. In other words, the center of the nozzle section 110 makes a relative linear movement on the substrate G along the loci H1-K-H3. As a result, the entire surface of the substrate G is coated with the resist solution 8*b*. It should be noted that the solvent 8*a* is already present on the surface of the substrate G, with the result that the resist solution 8*b* is rapidly diffused over the entire surface of the substrate G. Since the entire surface of the substrate G is coated uniformly with the resist solution 8*b* in this fashion, the consumption of the resist solution 8*b* can be markedly decreased. Incidentally, it is also possible to permit the resist solution 8*b* to be spurted from the second nozzle 112 while spurting the solvent 8*a* from the first nozzle 111 so as to further shorten the processing time.

When the substrate G is in the third position and when the center of the nozzle section 110 arrives at the position N3, the movements of both the substrate G and the nozzle section 110 are stopped and, at the same time, the supply of the resist solution 8*b* is stopped (step S607). Then, the nozzle section 110 is brought back to the home position (step S608), and the lid 46 is closed (step S609).

Further, the drain cup 44 begins to be exhausted and, at the same time, the substrate G and the rotary cup 42 begin to be rotated in synchronism (step S610). In this step S610, the rotating speed of the substrate G is set at about 500 rpm, and the maximum rotating speed of the substrate G is set at about 1350 rpm. As a result, the excess resist solution 8*b* is centrifugally separated from the substrate G so as to form a resist film of a uniform thickness on the substrate G.

In the next step, the lid 46 is opened (step S611), followed by moving upward the spin chuck 40 so as to release the substrate G held by vacuum suction by the spin chuck 40. The substrate G is then taken up from the spin chuck 40 by a transfer mechanism (not shown) so as to be transferred into the peripheral coating film removing device 21B (step S613).

In the peripheral coating film removing device 21B, a thinner is applied to the peripheral portion of the substrate G so as to remove the resist coating film from the peripheral portion of the substrate G (step S7). Then, a mounting table (not shown) is moved upward so as to permit the second main transfer arm mechanism 14B to take up the substrate G from the mounting table and to transfer the substrate G out of the unit 21.

The second main transfer mechanism 14B transfers the substrate G into a baking unit 26. The substrate G is heated in the baking unit 26 so as to evaporate the solvent from the resist coating film (step S8). Then, the substrate G is transferred into the cooling unit 27 so as to be cooled. Further, the substrate G is transferred through the interface section 6 into the light exposure device 7. The resist coating film is selectively exposed in a pattern within the exposure device 7 (step S9).

After the light exposure step S9, the substrate G is transferred into the unit 28, in which a developing solution is applied to the resist coating film so as to develop a latent pattern image (step S10). Further, pure water is applied to the substrate G for the rinsing purpose, followed by heating the substrate G for the drying purpose (step S11). Still further, the substrate G is transferred into the cooling unit 33 for the cooling purpose. The substrate G after the processing is delivered onto the first to third main transfer arms 14A, 14B, 14C and onto the sub-transfer arm 13. Further, the substrate G is housed in the cassette C2 within the loader section 2 by the sub-transfer arm 13. Finally, the cassette C2 housing the treated substrate G is transferred out of the system 1 so as to be further transferred toward the process apparatus in the subsequent steps (step S12).

Figure 11:
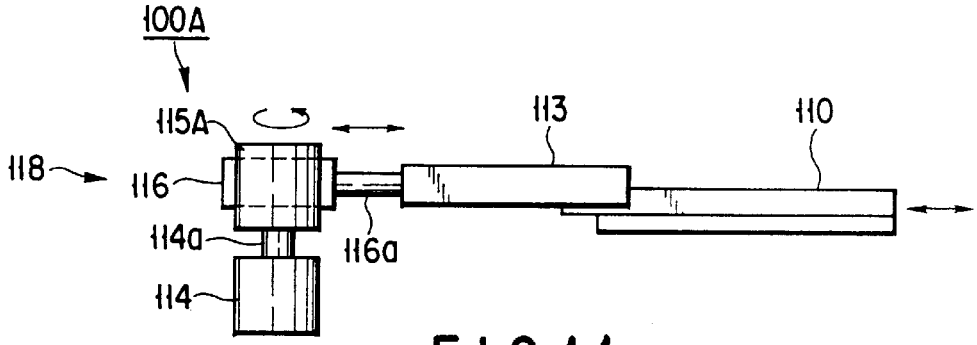
FIG. 11 schematically shows a back-and-forth moving mechanism for moving the linear nozzle back and forth in the apparatus according to another embodiment of the present invention.
Figure 12:
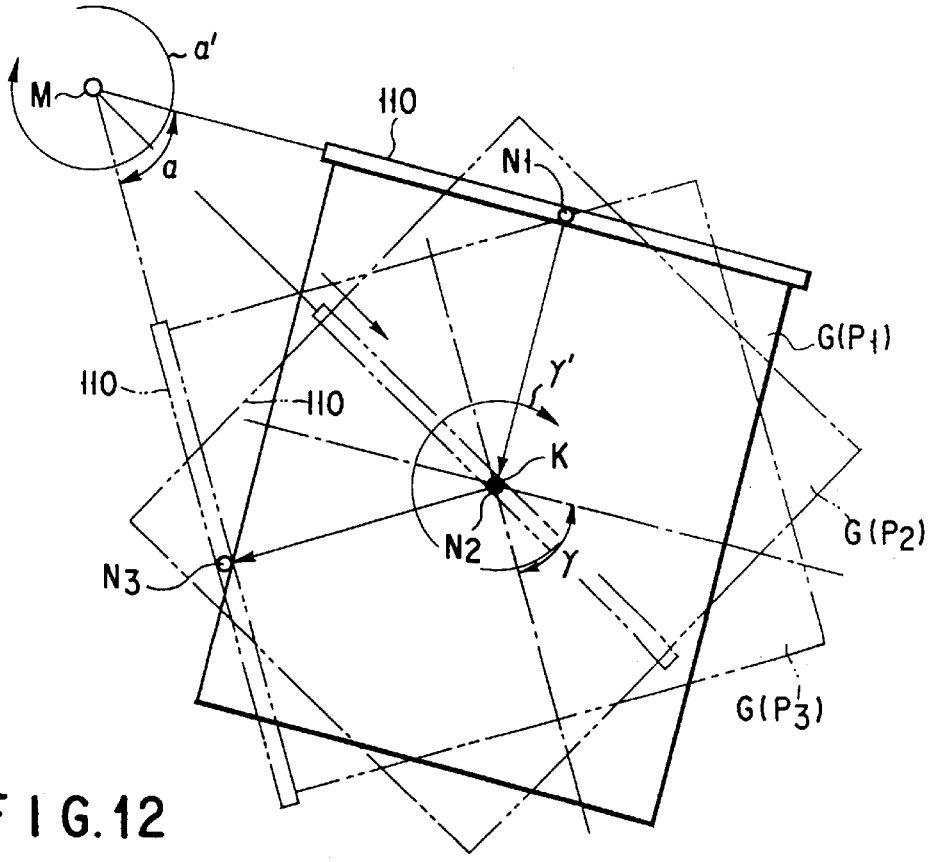
FIG. 12 is a plan view for explaining the operation of each of the linear nozzle and the LCD substrate in the apparatus according to still another embodiment of the present invention.

FIGS. 11 and 12 show a nozzle moving mechanism 100A according to another embodiment of the present invention. Those portions of this embodiment which are common with those of the embodiment described above are omitted in the following description.

As shown in FIG. 11, the nozzle moving mechanism 100A is provided with a back-and-forth moving mechanism 118 in place of the swinging mechanism 140. The back-and-forth moving mechanism 118 comprises a rod 116*a* joined to the supporting arm 113 and a cylinder 116 mounted to the case 115A. The cylinder 116 communicates with an air supply source (not shown) which is controlled by the controller 120. If the rod 116*a* is projected out of or retreated into the cylinder 116, the nozzle section 110 is moved forward or backward in the longitudinal direction. The operation of the back-and-forth moving mechanism 118 is controlled by the controller 120 in synchronism with the rotating operation of the substrate G and with the resist solution spurting operation.

As shown in FIG. 12, the nozzle section 110 is controlled by the controller 120 so as to perform a rocking operation about the center M of rocking with a rocking angle of a. Also, the substrate G is controlled by the controller 120 so as to perform a rotating operation about the center K of rotation with a rotating angle $\gamma$. It should be noted that the swinging angle $\alpha$ is equal to the rotating angle $\gamma$. In addition, the differentiation amount $d\alpha/dt$, which is obtained by differentiating the rocking angle $\alpha$ with time is equal to the differentiation amount $d\gamma/dt$, which is obtained by differentiating the rotating angle $\gamma$ with time. The operations of the nozzle section 110 and the substrate G are controlled in the coating step 6 so as to maintain the relationship between the rocking angle $\alpha$ and the rotating angle $\gamma$ as described above.

When the substrate G is in the first position P1, the center N1 of the nozzle section 110 overlaps with the center of the shorter side of the substrate G. Also, when the substrate G is in the third position P3, H the center N3 of the nozzle section 110 overlaps with the center of the shorter side of the substrate G. However, when the substrate G is in the second position P2, the center N2 of the nozzle section 110 does not overlap with the center K of rotation of the substrate G. Therefore, the operation of the cylinder 116 is controlled such that, when the substrate G is rotated from the first position P1 to the second position P2, the nozzle section 110 is moved forward and, when the substrate G is rotated from the second position P2 to the third position P3, the nozzle section 110 is moved backward. It follows that the center of the nozzle section 110 makes a relative linear movement on the substrate G along the loci N1-N2-N3.

Since the rotation of the substrate G and the rocking of the nozzle section 110 are carried out in synchronism as described above, the relative positional relationship between the substrate G and the nozzle section 110 is as shown in FIG. 12. To be more specific, the number of pulses for the servo motor 51 and the stepping motor 114, which are calculated on the basis of the rocking angle $\alpha$, the rotating angle $\gamma$, the differentiation amount ($d\alpha/dt$) of the rocking angle, and the differentiation amount ($d\gamma/dt$) of the rotating angle, are set in advance in the controller 120, and is supplied from the controller 120 to each of the servo motor 51 and the stepping motor 114. Alternatively, it is possible to feed back the number of pulses extracted from one of the servo motor 51 and the stepping motor 114 to the other in synchronism with the number of pulses of the other of the servo motor 51 and the stepping motor 114. Of course, an additional system can be employed for driving the motors in synchronism.

In each of the embodiments described above, a resist solution is used as a coating solution. However, an additional solution such as a developing solution can be employed in the coating system of the present invention.

Also, in each of the embodiments described above, a coating treatment is applied to a rectangular LCD substrate. However, an additional substrate such as a circular semiconductor wafer can also be processed by the coating system of the present invention.

What should also be noted that the nozzle moving mechanism included in the coating apparatus of the present invention has a small foot print, making it possible to prevent effectively the coating apparatus from being made bulky.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of forming a coating film, in which a coating solution is supplied from a linear nozzle supported by a horizontal arm onto a rectangular substrate held by a spin chuck arranged inside a cup having an opening so as to form a coating film on the rectangular substrate, comprising the steps of:

(a) allowing the spin chuck to hold rotatably the rectangular substrate and aligning the linear nozzle and the substrate relative to each other such that the linear nozzle is disposed in parallel with a short side or long side of the rectangular substrate; and (b) supplying a coating solution from the linear nozzle onto the substrate while rocking the linear nozzle in substantially a same direction as a rotating direction of the rectangular substrate while rotating the rectangular substrate, and shaking the linear nozzle in substantially an opposite direction to the rotating direction of the rectangular substrate, so that the coating solution is substantially uniformly spread over an entire upper surface of the rectangular substrate.

2. A method of forming a coating film, according to claim 1, wherein, in said step (b), the linear nozzle is advanced or retreated in a longitudinal direction of the horizontal arm.

3. The method of forming a coating film according to claim 1, further comprising the steps of:

(c) mounting a lid to said cup to close the upper opening of the cup and, thus, to have said substrate confined within the cup; and (d) rotating the substrate confined within the cup so as to make the coating film formed on the substrate uniform in thickness.

4. The method of forming a coating film according to claim 1, wherein said coating solution is supplied from said linear nozzle to the substrate in said step (b) to cover an entire region in at least a width direction or length direction of the substrate.

5. The method of forming a coating film according to claim 4, wherein said substrate is rectangular, and said coating solution is supplied from said linear nozzle to the substrate in said step (b) to cover an entire region along the shorter side of the substrate.

6. The method of forming a coating film according to claim 1, wherein a solvent is supplied to the substrate before said step (b).

7. The method of forming a coating film according to claim 1, wherein said solvent is supplied from said linear nozzle.

8. The method of forming a coating film according to claim 1, wherein, in said step (b), said linear nozzle is rocked along a circle in which a straight line joining the center of rotation of the substrate and the center of rocking of the linear nozzle constitutes the diameter.

9. A coating apparatus comprising:

a spin chuck for rotatably holding a rectangular substrate;

a linear nozzle for supplying a coating solution onto the rectangular substrate;

a switching mechanism for switching supply and stop of supply of the coating solution from the linear nozzle;

a rotation drive mechanism for rotating the spin chuck;

a horizontal arm for supporting the linear nozzle movably above the rectangular substrate held by the spin chuck;

a rocking mechanism for supporting the horizontal arm and rocking the horizontal arm substantially within a horizontal surface;

a shaking mechanism mounted on the horizontal arm, for shaking the linear nozzle substantially within the horizontal plane; and a control mechanism for controlling each of the switching mechanism, the rotation drive mechanism, the rocking mechanism and the shaking mechanism, so that a coating solution is substantially uniformly spread over an entire upper surface of the rectangular substrate when the coating solution is supplied from the linear nozzle onto the rectangular substrate while rocking the linear nozzle in substantially a same direction as a rotating direction of the rectangular substrate while rotating the rectangular substrate, and shaking the linear nozzle in substantially an opposite direction to the rotating direction of the rectangular substrate.

10. The coating apparatus according to claim 9, further comprising a solvent supply source for supplying a solvent to said linear nozzle.

11. The coating apparatus according to claim 9, wherein said controller controls the supporting arm rocking mechanism and the shaking mechanism to establish a relationship $\alpha'=2\gamma'=2\beta'$ among the angular speed $\gamma'$ at which substrate is rotated, the angular speed $\alpha'$ at which the supporting arm is rocked, and the angular speed $\beta'$ at which the linear nozzle is shaken relative to the supporting arm.

12. The coating apparatus according to claim 9, wherein said shaking mechanism comprises:

a stationary frame provided with a first bevel gear for swingably supporting the supporting arm;

a pivot provided with a second bevel gear and joined to said linear nozzle; and a gear shaft arranged within the hollow portion of the supporting arm and provided with bevel gears engaged with said first and second bevel gears, respectively.

13. The coating apparatus according to claim 9, wherein said shaking mechanism comprises:

a pivot rotatably mounted to said supporting arm and joined to said linear nozzle; and a small motor whose rotary driving shaft is joined directly or indirectly to said pivot and whose operation is controlled by said controller.

14. The coating apparatus according to claim 9, wherein the nozzle moving mechanism comprises:

a supporting arm;

a supporting arm rocking mechanism for rocking the supporting arm; and a back-and-forth moving mechanism mounted to the supporting arm for moving the linear nozzle forward or backward in the longitudinal direction of the supporting arm.

15. The coating apparatus according to claim 9, wherein the control section permits the angular speed $\delta'$ at which the linear nozzle is rocked and the angular speed $\gamma'$ at which the substrate is rotated to be made equal to each other.

16. The coating apparatus according to claim 9, wherein the control section permits the linear nozzle to be rocked along a circle in which a straight line joining the center of rotation of the substrate and the center of rocking of the linear nozzle constitutes the diameter.

17. The coating apparatus according to claim 9, further comprising a cup surrounding the substrate held by said spin chuck and receiving the coating solution dropping from the substrate.

* * * * *